US011395071B2

(12) United States Patent
Zhao et al.

(10) Patent No.: US 11,395,071 B2
(45) Date of Patent: Jul. 19, 2022

(54) SOUND GENERATOR

(71) Applicant: Goertek Inc., Weifang (CN)

(72) Inventors: Guodong Zhao, Weifang (CN); Zedong Zheng, Weifang (CN); Peijun Li, Weifang (CN); Yaqian Ji, Weifang (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 16/961,463

(22) PCT Filed: Dec. 24, 2018

(86) PCT No.: PCT/CN2018/123194
§ 371 (c)(1),
(2) Date: Jul. 10, 2020

(87) PCT Pub. No.: WO2019/137191
PCT Pub. Date: Jul. 18, 2019

(65) Prior Publication Data

US 2020/0382875 A1 Dec. 3, 2020

(30) Foreign Application Priority Data

Jan. 10, 2018 (CN) ..... 201820043738.X
Feb. 12, 2018 (CN) ..... 201810146756.5

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2400/11* (2013.01)

(58) Field of Classification Search
None
See application file for complete search history.

(56) References Cited

U.S. PATENT DOCUMENTS

2011/0123061 A1* 5/2011 Kamimura ..... H04R 31/00 381/412
2013/0148834 A1* 6/2013 Seo ..... H04R 1/2811 381/338

(Continued)

FOREIGN PATENT DOCUMENTS

CN 102413405 A 4/2012
CN 202799131 U 3/2013

(Continued)

OTHER PUBLICATIONS

International Search Report and Written Opinion dated Mar. 26, 2019 in International Application No. PCT/CN2018/123194 (with English translations).

*Primary Examiner* — Walter F Briney, III
(74) *Attorney, Agent, or Firm* — Baker Botts, LLP

(57) ABSTRACT

A sound generator, which comprises: a housing, a vibration system and a magnetic circuit system. The vibration system and the magnetic circuit system are sequentially accommodated and fixed at a first end of the housing from top to bottom; the magnetic circuit system is provided with a rear sound hole; the housing comprises a first portion corresponding to the vibration system and the magnetic circuit system, and a second portion integrally extending downward from the first portion beyond a bottom surface of the magnetic circuit system; a second end portion of the housing is integrally provided with a housing bottom wall or separately mounted with a lower cover plate; and a rear cavity which is in communication with the rear sound hole is formed between the second portion of the housing, the bottom surface of the magnetic circuit system, and the housing bottom wall or the lower cover plate.

17 Claims, 7 Drawing Sheets

(56) References Cited

U.S. PATENT DOCUMENTS

| | | | | |
|---|---|---|---|---|
| 2014/0301587 | A1* | 10/2014 | Ji | H04R 1/025 381/332 |
| 2016/0165327 | A1* | 6/2016 | Crosby | H04R 1/2811 381/332 |
| 2016/0241938 | A1* | 8/2016 | Huang | H04R 1/023 |
| 2016/0345090 | A1* | 11/2016 | Wilk | B01D 53/04 |
| 2020/0213785 | A1* | 7/2020 | Matsuo | H04R 9/027 |

FOREIGN PATENT DOCUMENTS

| | | | |
|---|---|---|---|
| CN | 203574814 | U | 4/2014 |
| CN | 203747999 | U | 7/2014 |
| CN | 106131757 | A | 11/2016 |
| CN | 207835801 | U | 9/2018 |

* cited by examiner

SOUND GENERATOR

CROSS-REFERENCE TO RELATED APPLICATIONS

This application is a National Stage of International Application No. PCT/CN2018/123194, filed on Dec. 24, 2018, which claims priority to Chinese Patent Application No. 201810146756.5, filed on Feb. 12, 2018 and Chinese Patent Application No. 201820043738.X, filed on Jan. 10, 2018, all of which are hereby incorporated by reference in their entireties.

TECHNICAL FIELD

The present disclosure relates to the technical field of sound generating device.

BACKGROUND

The sound generating device is an important component in electronic products and is used to convert electrical signals into acoustic signals. The development trend of the electronic products is to get thinner and thinner, and in order to achieve more functions, there are more and more components in the electronic products. Hence, the space reserved for the sound generating device is bound to become smaller and smaller. Furthermore, the electronic products are paying more and more attention to the user's music experience, so the sound generating device is required to have better sound quality.

In order to improve music experience effects, the sound generating device in the prior art installs a sound generator in a box with a volume. The sound generator comprises a housing, and a magnetic circuit system and a vibration system accommodated and fixed in the housing. A rear cavity is formed between the sound generator and the box. The larger the rear cavity, the lower the low-frequency resonance frequency of the product, thereby the low-frequency performance of the product is improved. The sound generating device in the prior art generally has two structures: one structure is similar to the sound box, wherein the box is of a rectangular parallelepiped type, and a sound generator is fixed on a front panel of the box, forming a rear cavity in a thickness direction and rear horizontal direction, which is not conducive to the thinning and miniaturization of the product; another structure is that the box has an accommodating cavity for accommodating a sound generator and a rear cavity located on the side of the sound generator, wherein forming the rear cavity on the side of the sound generator can obtain the largest possible rear cavity volume, but at the same time, it also leads to a larger space occupied by the entire sound generating device in a horizontal direction, which is not conducive to the miniaturization of the product.

Furthermore, in the sound generating device in the prior art, the shape of the rear cavity is irregular, and the airflow from the sound generator into the rear cavity is not stable enough to cause problems such as polarization and distortion, and the acoustic effect is not satisfactory.

If the volume of the sound generating device of the existing structure is reduced, the volume of the rear cavity of the sound generating device is bound to be reduced. Therefore, it is necessary to provide a new sound generating device, which has a small volume and good performance to meet the development needs of electronic products.

SUMMARY

The embodiment of the invention provides a sound generator, which can meet the requirements of small volume and have better performance.

The invention further provides a sound generator, comprising a housing, a vibration system and a magnetic circuit system; wherein, the vibration system and the magnetic circuit system are sequentially accommodated and fixed at a first end of the housing from top to bottom;

the magnetic circuit system is provided with a rear sound hole;

the housing comprises a first portion corresponding to the vibration system and the magnetic circuit system, and a second portion integrally extending downward from the first portion beyond a bottom surface of the magnetic circuit system;

a second end portion of the housing is integrally provided with a housing bottom wall or separately mounted with a lower cover plate; and a rear cavity which is in communication with the rear sound hole is formed between the second portion of the housing, the bottom surface of the magnetic circuit system and the housing bottom wall or the lower cover plate.

Optionally, the housing is a straight cylinder structure with openings at two ends; the vibration system comprises a diaphragm and a voice coil fixed below the diaphragm, the diaphragm being fixed on an end surface of a first end opening of the housing; and the lower cover plate is mounted at a second end opening of the housing.

Optionally, the magnetic circuit system comprises a magnetic conductive yoke, and a central magnetic circuit portion mounted on an upper surface of the magnetic conductive yoke and a side magnetic circuit portion;

a magnetic gap accommodating the voice coil is formed between the central magnetic circuit portion and the side magnetic circuit portion; and at least one of the central magnetic circuit portion and the side magnetic circuit portion is provided with a permanent magnet.

Optionally, an outer side of the side magnetic circuit portion is disposed in close contact with an inner wall of the housing.

Optionally, a peripheral side of the magnetic conductive yoke is disposed in close contact with an wall of the housing.

Optionally, the magnetic conductive yoke is rectangular, and a corner of the magnetic conductive yoke is provided with a first rear sound hole communicating with the magnetic gap and the rear cavity.

Optionally, the central magnetic circuit portion comprises a central magnet and a central magnetic conductive plate provided on a top surface of the central magnet; at the central magnetic circuit portion, the magnetic circuit system is provided with a through hole that sequentially penetrates the magnetic conductive yoke and the central magnet as a part of the rear cavity, and a second rear sound hole communicating with the through hole is provided on the central magnetic conductive plate.

Optionally, a ratio of an opening volume of the center magnet to the center magnet volume before opening is less than or equal to 35%.

Optionally, a second end of the housing is open, the lower cover plate is mounted at the second end opening of the housing, an inner well of the first end of the housing is provided with a convex edge extending toward a center of the housing, and an upper edge of the magnetic circuit system abuts and is fixed on a lower surface of the convex edge.

Optionally, the first end of the housing is open, an inner side of an end surface of the first end opening of the housing has a recessed first step end surface, and the first step end surface has a bottom surface and a side surface for mounting the diaphragm.

Optionally, an upper cover plate mounted on the housing is also provided above the diaphragm, and an edge of the upper cover plate is located inside the side surface of the first step end surface.

Optionally, a first protrusion is provided outside the bottom surface of the edge of the upper cover plate, and an ultrasound line is provided on the first protrusion;

the bottom surface of the first step end surface is provided with a first groove at a position corresponding to the first protrusion, and the first protrusion of the upper cover plate is inserted into the first groove and is ultrasonically welded to a bottom surface of the first groove Optionally, the first end of the housing is open, a second groove is provided outside an end surface of the first end opening of the housing, and the diaphragm is fixed inside the end surface of the first end opening;

an upper cover plate mounted on the housing is also provided above the diaphragm, and a second protrusion is provided outside a bottom surface of an edge of the upper cover plate, and the second protrusion extends into the second groove and is fixed by bonding.

Optionally, the housing is of a rectangular structure.

Optionally, the rear sound hole is provided with a breathable spacer, and the rear cavity is filled with a sound absorbing material.

Optionally, the housing bottom wall or the lower cover plate is provided with a filling hole for filling the sound absorbing material, and a cover sheet is encapsulated on the filling hole.

Optionally, the cover sheet is provided with air-permeable micro-holes that allow air to pass and do not allow the sound absorbing material to pass; or, the cover sheet is provided with a leak hole, and the leak hole is covered with a damping mesh that allows air to pass and does not allow the sound absorbing material to pass.

Optionally, a second end of the housing is open, the lower cover plate is mounted at the second end opening of the housing, and the lower cover plate is made of metal.

Optionally, the lower cover plate is of a flat plate shape; or the lower cover plate is of a bowl-shaped structure provided with a bottom wall and a side wall.

Optionally, a second end of the housing is open, the lower cover plate is mounted at the second end opening of the housing, and the lower cover plate is adhered to an end surface of the second end opening of the housing by a strand layer; or an inner side of the end surface of the second end opening of the housing is provide with a recessed second step end surface, the second step end surface is provided with a top surface and side surfaces for mounting the lower cover plate; the lower cover plate is of a flat plate shape, an edge of the lower cover plate is provided with a recessed portion recessed toward the rear cavity, the recessed portion abuts on the top surface of the second step end surface and forms a first holding strand groove between the side surfaces of the second step end surface, and the first holding strand groove is coated with strands to fix the lower cover plate on the housing; or, the lower cover plate is of a bowl-shaped structure provided with a bottom wall and a side wall, an end of the side wall of the lower cover plate is bent outward to provide a mounting edge, the mounting edge abuts on the top surface of the second step end surface and forms a second holding strand groove between the side surfaces of the second step end surface, and the second holding strand groove is coated with strands to fix the lower cover plate on the housing; or a plastic edge is injection-molded on a periphery of the lower cover plate, and the plastic edge is ultrasonically welded to the second end opening of the housing.

Optionally, the first end of the housing is open, and the second end portion of the housing is integrally provided with a housing bottom wall, the housing bottom wall being made of a plastic material; or, the housing bottom wall comprises an integrally molded metal sheet.

In the technical solution provided in the embodiment of the invention, the housing comprises a first portion corresponding to the vibration system and the magnetic circuit system, and a second portion integrally extending downward from the first portion beyond a bottom surface of the magnetic circuit system; and a second end portion of the housing is integrally provided with a housing bottom wall or separately mounted with a lower cover plate, and a rear cavity being formed between the second portion of the housing, the magnetic circuit system, and the housing bottom wall or the lower cover plate. Compared with the prior art, the invention directly forms a sufficiently large rear cavity space from the lower end portion of the housing of the sound generator. Firstly, there is no need to additionally configure the box structure forming the rear cavity, thus it will not increase the occupied space in the horizontal direction, and the peripheral area of the housing of the sound generator determines the size of the space occupied by the entire sound generating device in the electronic product, which helps to achieve miniaturization of the product, and on the basis of miniaturization, it can take into account the volume of the magnetic circuit system and the volume of the rear cavity, thereby ensuring acoustic performance. Secondly, a rear cavity is arranged directly below the vibration system and the magnetic circuit system, and the rear cavity has a regular shape and is close to the rear acoustic hole. Compared with the prior art, the same large rear cavity volume can achieve a better acoustic effect. In addition, the technical solution provided by the embodiments of the invention is only to extend the design of the housing of the sound generator, the structure is simple, and there is no need to perform the assemble between the sound generator and the box or the box structure, which can simplify the manufacturing process and mounting process and increase the production efficiency. In addition, the embodiment of the invention also enlarges the volume of the rear cavity to improve the acoustic performance of the device by providing rear sound holes at the bottom edge and the central position of the magnetic circuit system, and effectively solves the problem that the acoustic resistance of the vibration becomes larger to make the stability of the vibration system becoming worse since the distance between the vibration system and the magnetic circuit of the miniaturized device is small.

Other features and advantages of the invention will become clear from the following detailed description of exemplary embodiments of the invention with reference to the drawings.

BRIEF DESCRIPTION OF THE DRAWINGS

The drawings that form a part of the description describe embodiments of the invention and together with the description serve to explain the principles of the invention.

DETAILED DESCRIPTION

Figure 1:
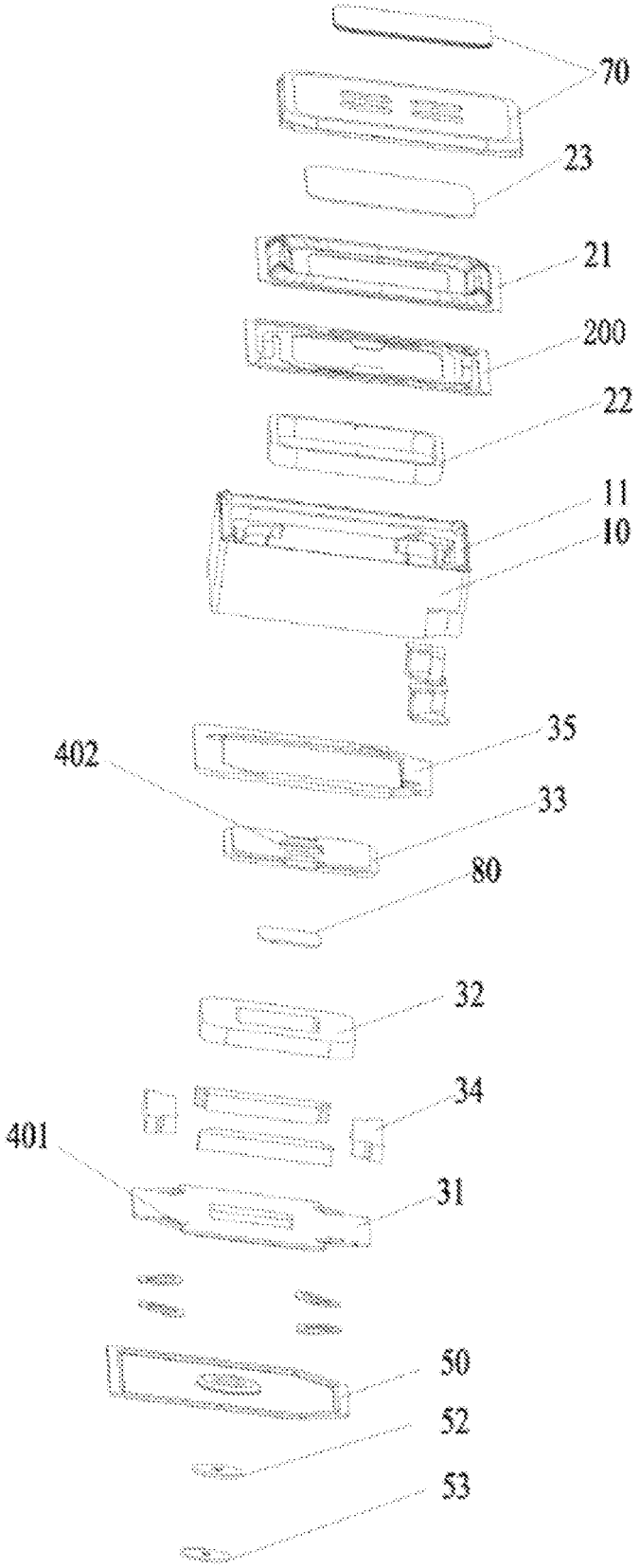
FIG. 1 is an exploded schematic view of a sound generator provided by an embodiment of the invention.

Various exemplary embodiments of the invention will now be described in detail with reference to the drawings. It should be noted that: unless specifically stated otherwise, the relative arrangement of components and steps, numerical expressions, and numerical values set forth in these embodiments do not limit the scope of the invention. The following description of at least one exemplary embodiment is actually merely illustrative, and in no way serves as any limitation on the invention and its application or use.

Techniques and devices known to those of ordinary skill in the related art may not be discussed in detail, but where appropriate, the techniques and devices should be considered as part of the description. In all examples shown and discussed herein, any specific values should be interpreted as exemplary only and not as limitations. Therefore, other examples of the exemplary embodiment may have different values. It should be noted that: Similar reference numerals and letters indicate similar items in the following drawings. Therefore, once an item is defined in one drawing, there is no need to discuss it further in subsequent drawings.

Figure 2:
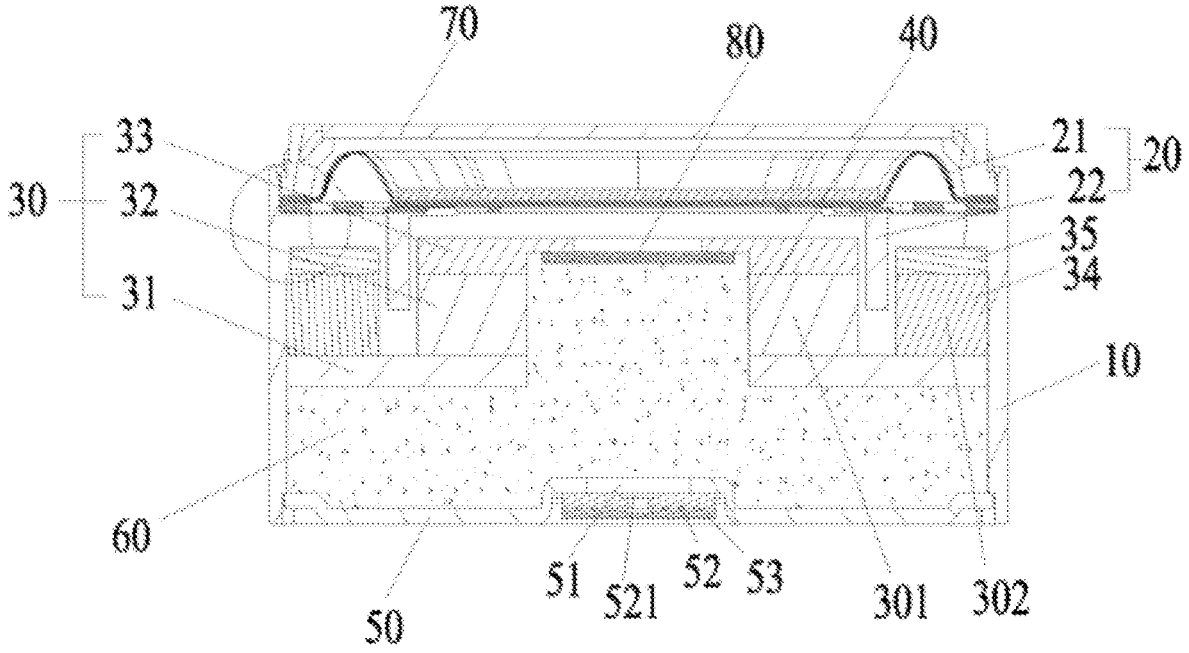
FIG. 2 is a schematic cross-sectional view of a sound generator provided by an embodiment of the invention.
Figure 3:
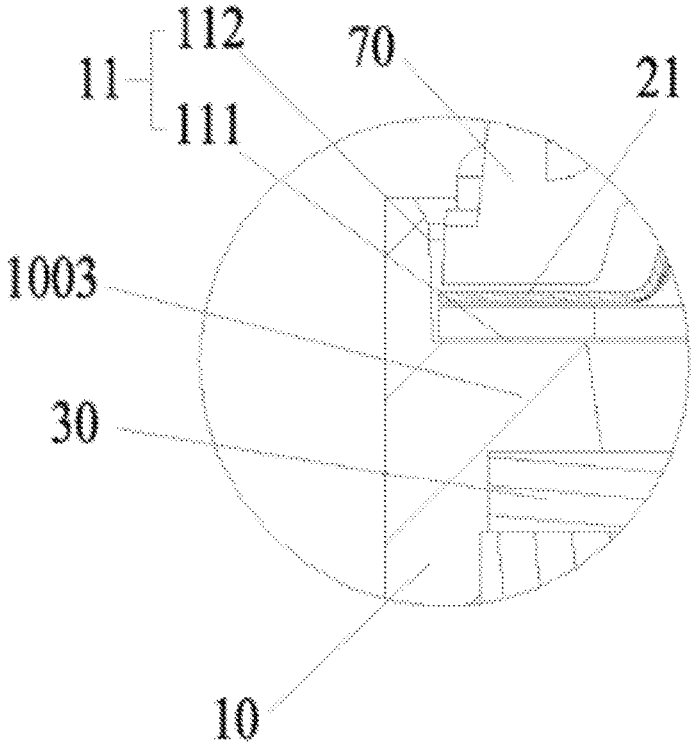
FIG. 3 is a partially enlarged schematic view of FIG. 2.
Figure 4:
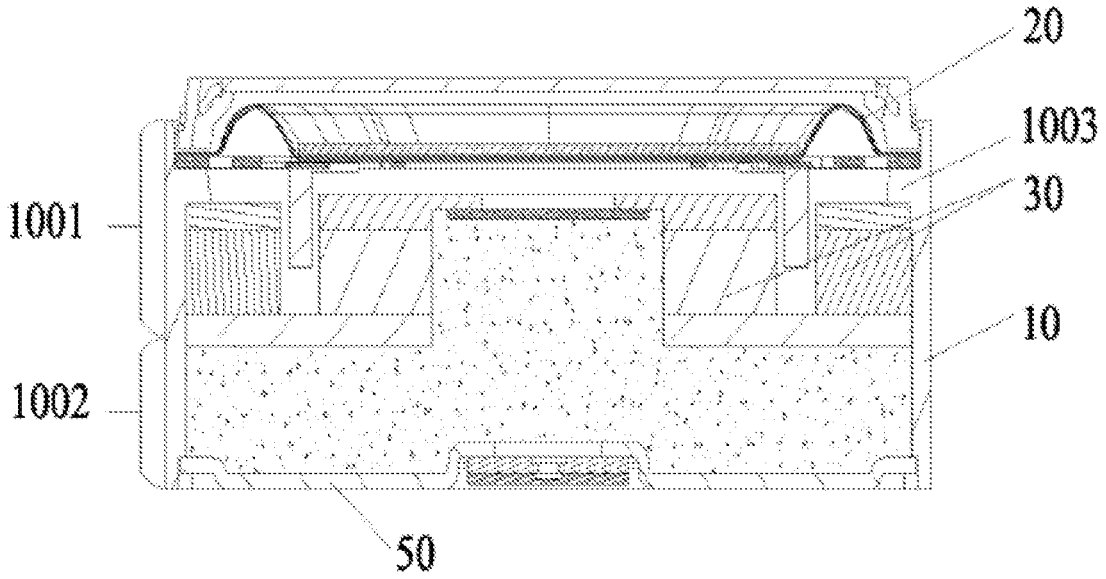
FIG. 4 is a schematic cross-sectional view of a sound generator provided by an embodiment of the invention.

FIGS. 1-5 show a schematic structural view of a sound generator provided by an embodiment of the invention. As shown in FIGS. 1, 2 and 4, a housing 10, a vibration system 20 and a magnetic circuit system 30 are included. The vibration system 20 and the magnetic circuit system 30 are sequentially accommodated and fixed at a first end of the housing 10 from top to bottom. Combined with FIGS. 4 and 5, the magnetic circuit system 30 is located below the vibration system 20 and fixed in the housing 10, and the magnetic circuit system 30 is provided with a rear sound bole 40. As shown in FIG. 4, the housing 10 comprises a first portion 1001 corresponding to the vibration system 20 and the magnetic circuit system 30, and a second portion 1002 integrally extending downward from the first portion 1001 beyond a bottom surface of the magnetic circuit system 30. A second end portion of the housing 10 is integrally provided with a housing bottom wall (not shown in the figures) or separately mounted with a lower cover plate 50; and a rear cavity 60 which is in communication with the rear sound hole 40 is formed between the second portion 1002 of the housing, the bottom surface of the magnetic circuit system 30, and the housing bottom wall or the lower cover plate 50.

Wherein, according to the actual situation, the above-mentioned housing 10 may be selected to have one end opening or two end opening structures. One end opening structure may be an upper end opening or a lower end opening, and the other end is a closed end. When the closed end is an upper end corresponding to the vibration system, it is allowed to open a small sound hole on the closed end, and after assembling the vibration system and the magnetic circuit system from the opening end, close the open end with a cover plate.

In a specific implementation structure, the housing 10 is a straight cylinder structure with two ends opening; as shown in FIGS. 1 and 2, a vibration system 20 is installed at a first end opening of the housing 10; the vibration system 20 comprises a diaphragm 21 and a voice coil 22 fixed below the diaphragm 21, the diaphragm 21 being fixed on an end surface of a first end opening of the housing 10; and the lower cover plate 50 is mounted at the second end opening of the housing 10.

Compared with the prior art, the technical solution provided by the embodiments of the invention directly forms a sufficiently large rear cavity space from the lower end portion of the housing of the sound generator. There is no need to additionally configure the box structure forming the rear cavity, thus it will not increase the occupied space in the horizontal direction, and the peripheral area of the housing of the sound generator determines the size of the space occupied by the entire sound generating device in the electronic product, which helps to achieve miniaturization of the product, and on the basis of miniaturization, it can take into account the volume of the magnetic circuit system and the volume of the rear cavity, thereby ensuring acoustic performance. Secondly, a rear cavity is arranged directly below the vibration system and the magnetic circuit system, and the rear cavity has a regular shape and is close to the rear acoustic hole. Compared with the prior art, the same large rear cavity volume can achieve a better acoustic effect. In addition, the technical solution provided by the embodiments of the invention is only to extend the design of the housing of the sound generator, the structure is simple, and there is no need to perform the assemble between the sound generator and the box or the box structure, which can simplify the manufacturing process and mounting process and increase the production efficiency. In addition, the embodiment of the invention also enlarges the volume of the rear cavity to improve the acoustic performance of the device by providing rear sound holes at the bottom edge and the central position of the magnetic circuit system, and also effectively solves the problem that because the distance between the vibration system of the miniaturized device and the magnetic circuit is small, the acoustic resistance of the vibration becomes larger and the stability of the vibration system becomes worse.

In a specific implementation structure, as shown in FIGS. 1 and 2, the magnetic circuit system 30 comprises a magnetic conductive yoke 31, and a central magnetic circuit portion 301 mounted on an upper surface of the magnetic conductive yoke 31 and a side magnetic circuit portion 302; a magnetic gap housing the voice coil 22 is formed between the central magnetic circuit portion 301 and the side magnetic circuit portion 302; and at least one of the central magnetic circuit portion 301 and the side magnetic circuit portion 302 is provided with a permanent magnet. In particular, the central magnetic circuit portion 301 comprises a central magnet 32 and a central magnetic conductive plate 33. The side magnetic circuit portion 302 comprises a side magnetic conductive plate 35 and a side magnet 34. In order to reduce the volume of the sound generator and maximize the magnetic circuit system, as shown in FIG. 2, the outer side of the side magnetic circuit portion 302 is disposed in close contact with the inner wall of the housing 10. Further, the peripheral side of the magnetic conductive yoke 31 and the inner wall of the housing 10 are also disposed in close contact with each other.

Further, the magnetic conductive yoke 31 may be rectangular, and a corner of the corresponding magnetic conductive yoke 31 may be provided with a first rear sound hole 401 communicating with the magnetic gap and the rear cavity 60. More specifically, as shown in FIG. 1, the magnetic conductive yoke 31 is a polygonal structure with four corners provided with notches; at the corner positions of the magnetic conductive yoke 31, that is, the positions near the edges of the notches, first rear sound holes 401 communicating with the magnetic gap and the rear cavity 60 is provided.

Furthermore, as shown in FIG. 2; the central magnetic circuit portion 301 of the magnetic circuit system 30 includes a central magnet 32 and a central magnetic conductive plate 32 provided on the top surface of the central magnet 32. At the central magnetic circuit portion 301, the magnetic circuit system 30 is provided with a through hole that sequentially penetrates the magnetic conductive yoke 31 and the central magnet 32 as a part of the rear cavity 60, and a second rear sound hole 402 communicating with the through hole is provided on the central magnetic conductive plate 33.

The four first rear acoustic holes 401 at the four corners of the magnetic conductive yoke 31 cannot achieve the best air circulation effect with the rear cavity 60, thus in this embodiment, a second rear sound hole 402 communicating with the through holes in the magnetic conductive yoke 31 and the central magnet 32 is provided on the central magnetic conductive plate 33 as a No. 5 rear sound hole. The four first rear sound holes 401 and the second rear sound hole 402 together constitute the rear sound hole 40 provided on the magnetic circuit system. The No. 5 rear sound hole can not only play the role of expanding the capacity of the acoustic cavity 60, but also solve the problem that the acoustic resistance of the vibration becomes larger to make the stability of the vibration system becoming worse since the distance between the vibration system and the magnetic circuit of the miniaturized device is small.

What needs to be added here is that the central area of the central magnet 32 contributes to the BL of the sound generator (a parameter which measures the strength of the driving system in the sound generator) less than the boundary area. Therefore, when the volume of the rear cavity 60 is limited, the center area of the central magnet 32 is hollowed-out to increase the volume of the rear cavity, which helps to improve the performance of the product. Although the hollowed-out area of the central magnet 32 has little influence on the BL value of the magnetic circuit system 30, it still has some influence. If the hollowed-out area of the central magnet 32 is too large, its influence on the BL value of the magnetic circuit system 30 cannot be ignored. If the hollowed-out area is too large, the BL value of the magnetic circuit system 30 will be smaller, and the performance of the product will be lower. Therefore, it is necessary to find a balance range such that the increase of the volume of the rear cavity 60 since the center magnet 32 is hollowed-out improves the product performance more than the reduction in the BL value of the magnetic circuit system reduces the product performance, thereby optimizing the product performance. Through simulation, it is known that when the hollowed-out volume of the center magnet 32 accounts for less than 35% of the original volume of the center magnet, the product performance is improved. When the hollowed-out volume of the center magnet 32 exceeds this range, the BL value of the magnetic circuit system 30 sharply decreases. At this time, the increase in the space of the rear cavity 60 has a lower performance improvement effect than the product performance reduction effect caused by the decrease of the BL value of the magnetic circuit system, and the overall performance is the reduction of product performance. Therefore, in the above technical solution provided by the invention, the opening volume of the center magnet should satisfy: the ratio of the opening volume of the center magnet 32 to the volume of the center magnet 32 before opening is less than or equal to 35%, and can be further controlled to 5%-30%.

Further, when the second end of the housing 10 is open and the lower cover plate 70 is installed at the second end opening of the housing, as shown in FIG. 3, the inner wall of the first end of the housing 10 is provided a convex edge 1003 extending toward a center direction of the housing 10, and an upper edge of the magnetic circuit system 30 abuts and is fixed on a lower surface of the convex edge 1003.

Figure 5:
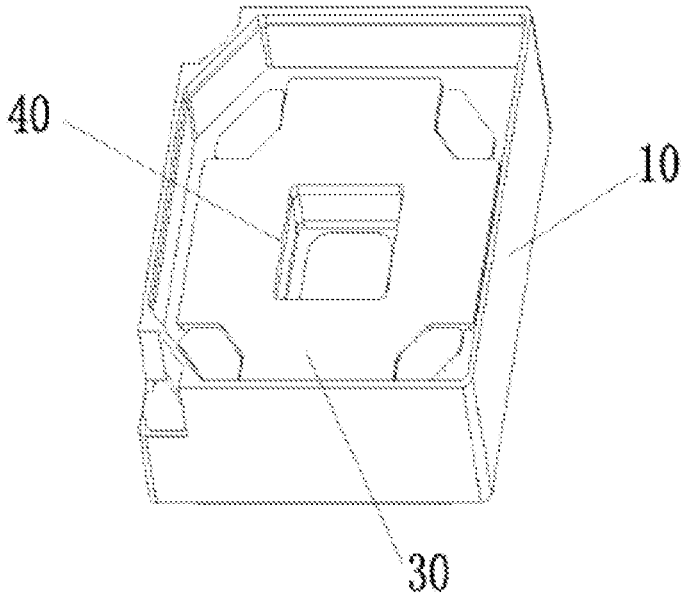
FIG. 5 is a schematic structural view of a specific implementation of a magnetic conductive yoke in a sound generator provided by an embodiment of the invention.

When the first end of the housing 10 is open, continuing to refer to FIG. 3, an inner side of an end surface of the first end opening of the housing 10 has a recessed first step end surface 11, and the first step end surface 11 has a bottom surface 111 and a side surface 112 for mounting the diaphragm 21. Referring to FIGS. 1 and 5, an upper cover plate 70 mounted on the housing 10 is also provided above the diaphragm 21, and an edge of the upper cover plate 70 is located inside the side 112 of the first step end surface 11.

More specifically, the sound generator provided in the embodiment of the invention may further include: a centering support 200 provided between the diaphragm 21 and the voice coil 22, and a reinforcement pan 23 provided on the side of the diaphragm 21 away from the magnetic circuit system 30; the reinforcement part 23 is fixed to the diaphragm 21, as shown in FIG. 1.

Figure 6:
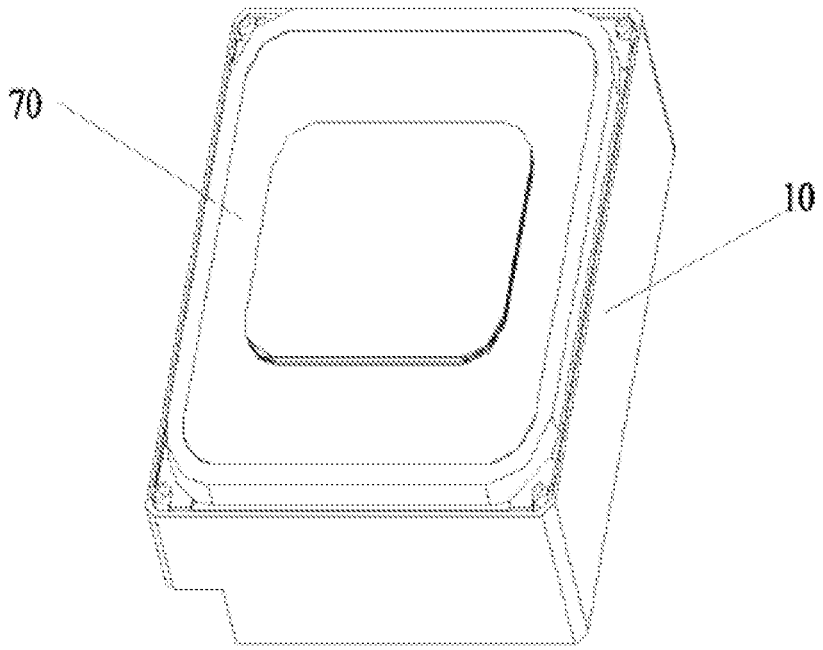
FIG. 6 is a schematic view of a top surface angle of a sound generator provided by an embodiment of the invention.
Figure 7:
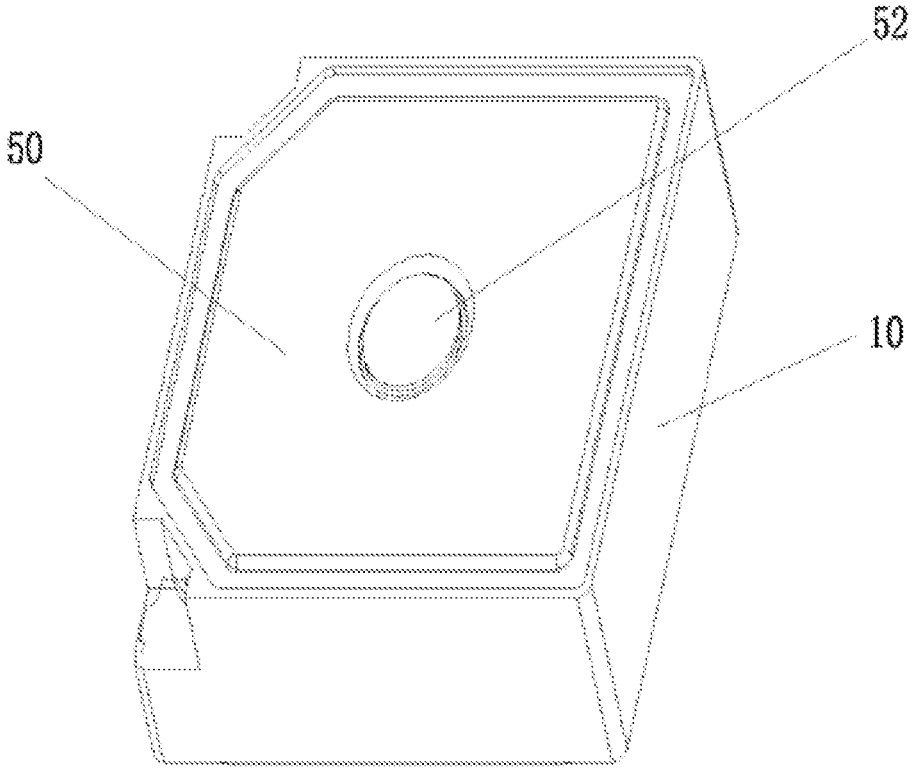
FIG. 7 is a schematic view of a bottom surface angle of a sound generator provided by an embodiment of the invention.

FIGS. 6 and 7 show outer contour schematic diagrams of an implementation form of a sound generator provided by an embodiment of the invention. As shown in FIGS. 6 and 7, the housing 10 of the sound generator provided in this embodiment may be a rectangular structure. For example, adopting the means that the sound generator of the technical solution provided by the embodiment of the invention can be prepared to have a plane size of (6-30) mm*(8-30) mm, and then by providing a rear sound hole with a capacity expansion effect on the magnetic circuit system, the purpose of reducing the height dimension of the sound generator is achieved.

Figure 8:
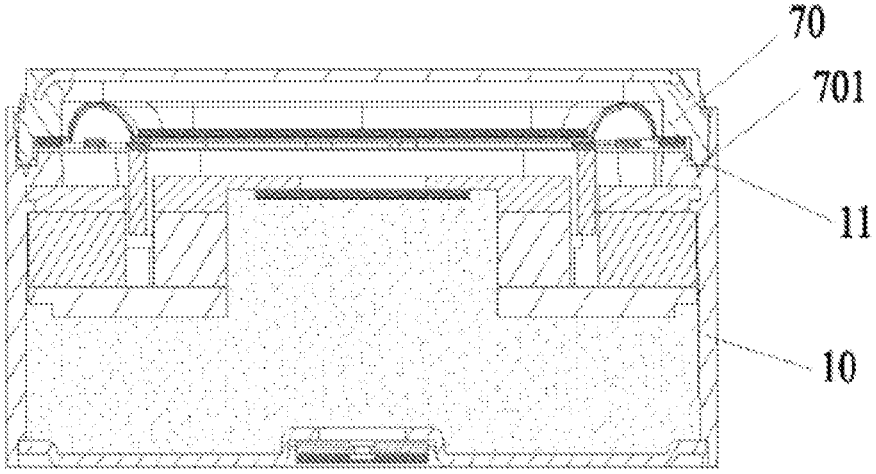
FIG. 8 is a connection structure schematic view of an upper cover plate and a housing in a sound generator provided by an embodiment of the invention.

Further, as shown in FIG. 8, a first protrusion 701 is provided outside the bottom surface of the edge of the upper cover plate 70, and an ultrasound line is provided on the first protrusion 701; the bottom surface of the first step end surface 11 is provided with a first groove at a position corresponding to the first protrusion 701, and the first protrusion 701 of the upper cover plate 70 is inserted into the first groove and is ultrasonically welded to a bottom surface of the first groove. Alternatively, a second protrusion is provided on bottom surface of the first step end surface, and an ultrasound line is provided on the second protrusion; a third groove is provided at a position corresponding to the ultrasonic line on the bottom surface of the edge of the upper cover plate, the second protrusion of the first step end surface is inserted into the third groove and fixed by ultrasonic welding; the realization structure is not provided in the drawings.

Figure 9:
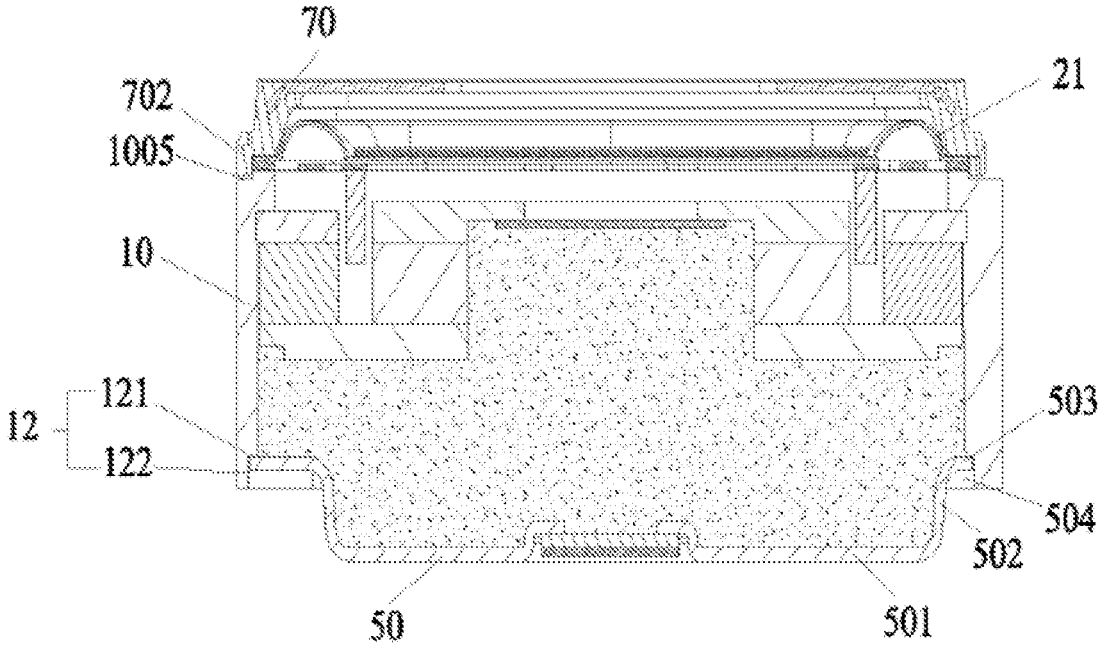
FIG. 9 is a connection structure schematic view of a lower cover plate and a housing in a sound generator provided by an embodiment of the invention.

Further, when the first end of the housing 10 is open, as shown in FIG. 9, a second groove 1005 is provided outside an end surface of the first end opening of the housing 10, and the diaphragm 21 is fixed inside the end surface of the first end opening; an upper cover plate 70 mounted on the housing 10 is also provided above the diaphragm 21, and a second protrusion 702 is provided outside a bottom surface of an edge of the upper cover plate 70, and the second protrusion 702 extends into the second groove 1005 and is fixed by bonding.

Further, as shown in FIGS. 1 and 2, the rear sound hole is provided with a breathable spacer 80, and the rear cavity 60 is filled with sound absorbing material. The sound absorbing material may be zeolite material, activated carbon material, or other materials with capacity expansion effect, which is not limited in this patent, wherein, the breathable spacer 80 is a mesh cloth that allows air to pass and does not allow sound absorbing material to pass, and is used to isolate the sound absorbing material and prevent it from entering the magnetic circuit system. Filling the rear cavity with sound absorbing material can further increase the volume of the rear cavity, which helps to improve the performance of the sound generator. The way of providing the breathable spacer 80 directly on the rear sound hole 40 can use all the space of the rear cavity to fill the sound absorbing material, thus increasing the filling amount of the sound absorbing material, and achieving a better capacity expansion effect. And, according to the embodiment, "the magnetic circuit system 30 is provided with a through hole that sequentially penetrates the magnetic conductive yoke 31 and the central magnet 32 as a part of the rear cavity 60, and a second rear sound hole 402 communicating with the through hole is provided on the central magnetic conductive plate 33", In the case that the through hole penetrating through the magnetic conductive yoke 31 and the central magnet 32 increases the rear cavity and is filled with sound absorbing material for the capacity expansion, the second rear sound hole 402 is located at the center of the magnetic circuit system, and the contact rate between the sound absorbing material at the position of the through hole and the air can be increased to achieve the best capacity expansion effect.

Further, as shown in FIGS. 1, 3 and 7, the housing bottom wall (not shown in the figures) or the lower cover plate 50 is provided with a filling hole 51 for filling the sound absorbing material, and a cover sheet 51 is encapsulated on the filling hole 50. The cover sheet 52 may be directly a hard sheet that is not air-permeable, and only serves to block the sound absorbing material. As an another embodiment, the cover sheet 52 is also provided with air-permeable micro-holes that allow air to pass and do not allow the sound absorbing material to pass; or, the cover sheet 52 is provided with a teak hole 521, and the leak hole 521 is covered with a damping 53 that allows air to pass and does not allow the sound absorbing material to pass. The above-mentioned specific embodiment makes the filling hole 51 serve as a leakage hole of the rear cavity, and can be used to balance the air pressure inside and outside the sound generator. Further, the acoustic resistance can be adjusted by adjusting the size of the air-permeable micro-holes or the mesh size of the damping net.

Figure 10:
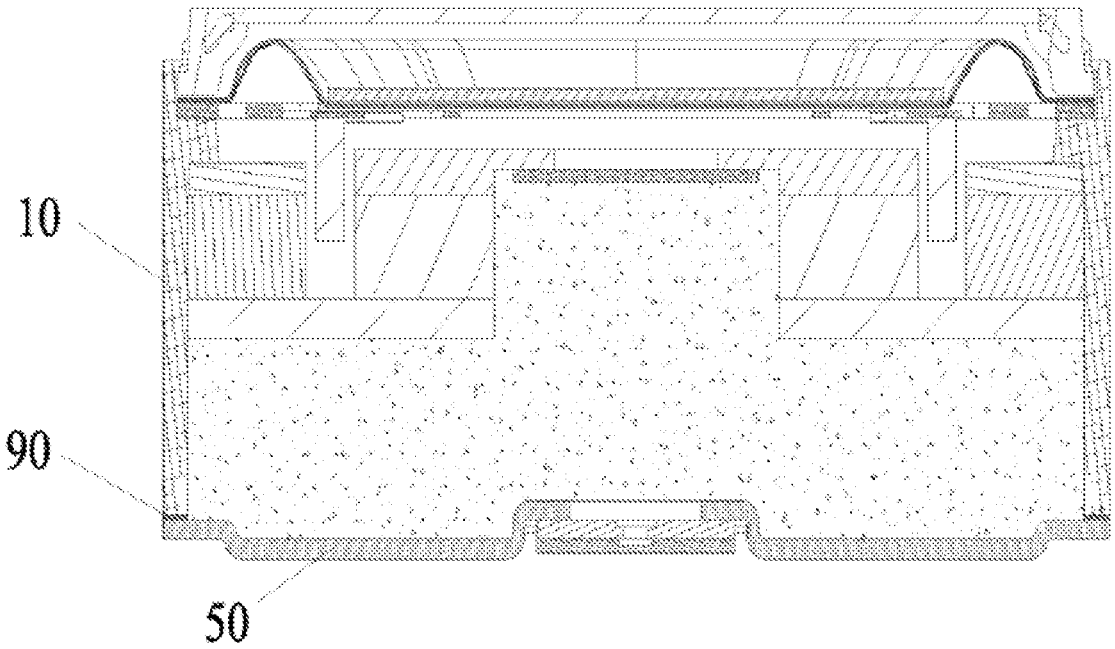
FIG. 10 is an another connection structure schematic view of a lower cover plate and a housing in a sound generator provided by an embodiment of the invention.
Figure 11:
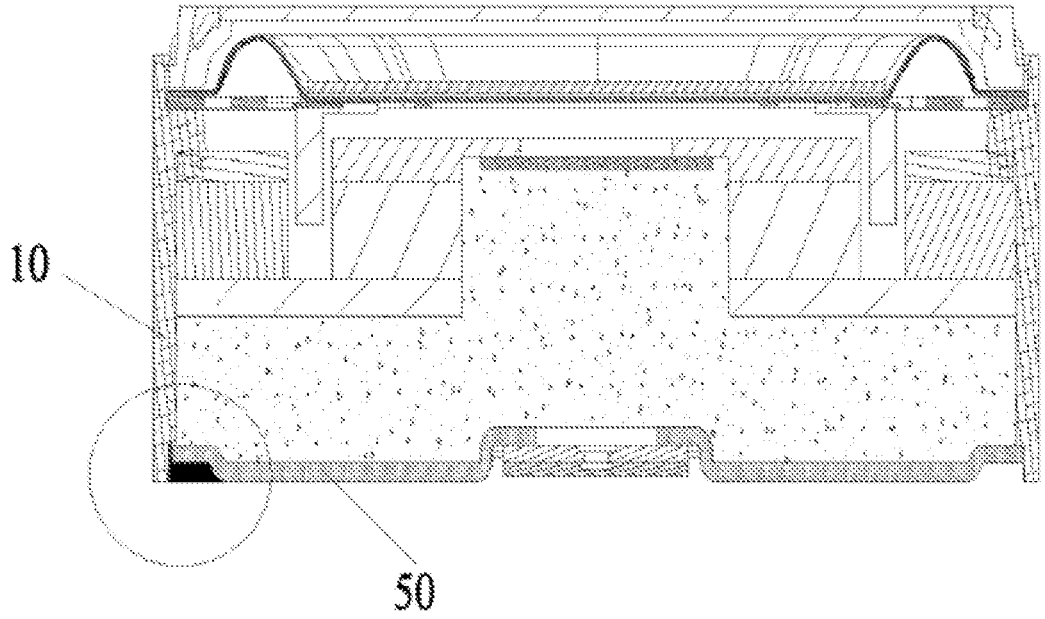
FIG. 11 is a further connection structure schematic view of a lower cover plate and a housing in a sound generator provided by an embodiment of the invention.
Figure 13:
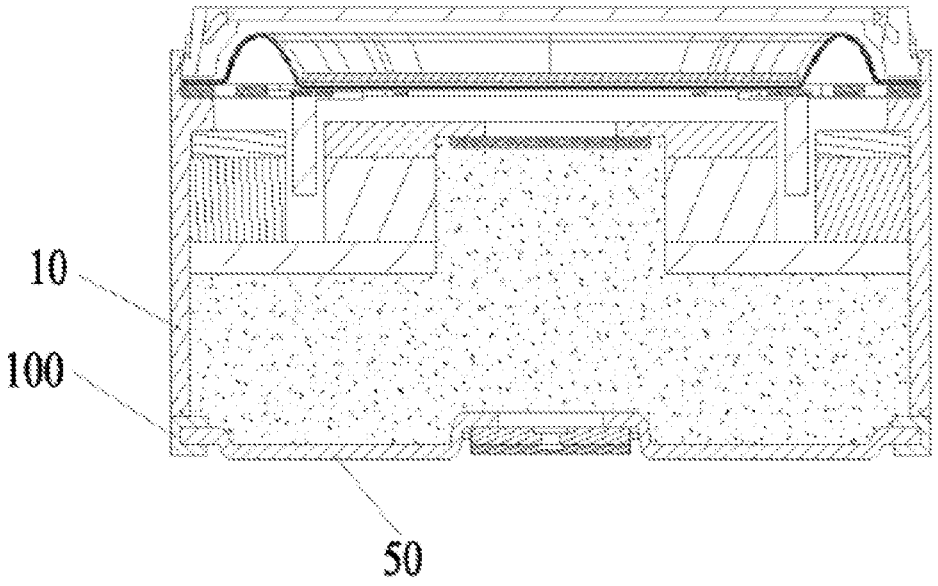
FIG. 13 is a further connection structure schematic view of a lower cover plate and a housing in a sound generator provided by an embodiment of the invention.

In an actual implementation, a lower cover plate 50 is installed at the second end opening of the housing 10. The lower cover plate 50 in this embodiment may be made of a metal material, which may be made thinner and occupy less space. The lower cover plate 50 is of a flat plate shape as shown in FIGS. 10, 11 and 13); or, the lower cover plate 50 is of a bowl-shaped structure provided with a bottom 501 and a side wall 502 (as shown in FIG. 9). In the embodiment in which the lower cover plate 50 is made of metal and is of a bowl-shaped structure, the metal lower cover plate 50 of the bowl-shaped structure has high strength and takes up little space, and the presence of the side wall 502 forms a part of the rear cavity space. Therefore, the height of the housing 10 can be reduced, thereby avoiding the problem that the excessively high plastic housing needs to increase the wall thickness to ensure the overall structural strength, which will increase the occupied space, and is more conducive to miniaturization of the product.

Referring to FIGS. 9-13, in the sound generator provided in this embodiment, the lower cover plate 50 may be connected to the second end opening of the housing 10 in the following three ways. Of course, the embodiments of the present invention are not limited to the following connection methods.

In the first way, as shown in FIG. 10, the lower cover plate 50 is bonded to the end surface of the second end opening of the housing 10 through the strand layer 90. Specifically, as shown in FIG. 10, the edge of the lower cover plate 50 extends to be flush with the outer side wall of the housing 10, and the board surface of the lower cover plate 50 opposite to the end surface of the second end opening of the housing 10 has a back strand. The lower cover plate 50 is bonded to the end surface of the second end opening of the housing 10 through its own back strand to seal the rear cavity.

Figure 12:
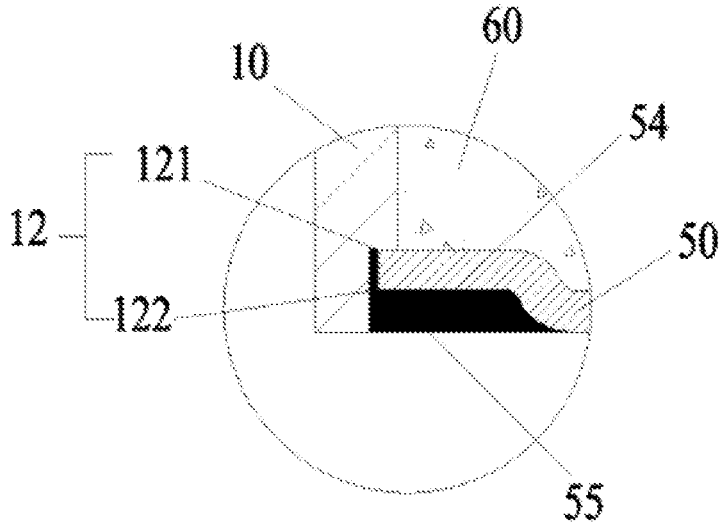
FIG. 12 is a partially enlarged schematic view of FIG. 11.

In the second way, as shown in FIGS. 9, 11 and 12, an inner side of the end surface of the second end opening of the housing 10 is provide with a recessed second step end surface 12, the second step end surface 12 is provided with a top surface 121 and side surfaces 122 for mounting the lower cover plate 50; as shown in FIGS. 11 and 12, the lower cover plate 50 is of a flat plate shape, an edge of the lower cover plate 50 is provided with a recessed portion 54 recessed toward the rear cavity 60, the recessed portion 54 abuts on the top surface 121 of the second step end surface and forms a first bolding strand groove 55 between the side surfaces 122 of the second step end surface 12, and the first holding strand groove 55 is coated with strands to fix the lower cover plate 50 on the housing 10. Alternatively, as shown in FIG. 9, the lower cover plate 50 is of a bowl-shaped structure provided with a bottom wall 501 and a side wall 502, an end of the side wall 502 of the lower cover plate 50 is bent outward to provide a mounting edge 503, the mounting edge 503 abuts on the top surface 121 of the second step end surface 12 and forms a second bolding strand groove 504 between the side surfaces 122 of the second step end surface 12, and the second holding strand groove 504 is coated with strands to fix the lower cover plate 50 on the housing 10.

In the third way, as shown in FIG. 13, a plastic edge 100 is injection-molded on a periphery of the lower cover plate 50, and the plastic edge 100 is ultrasonically welded to the second end opening of the housing 10.

In an another specific embodiment, the first end of the housing may be open, and the second end portion of the housing is integrally provided with a housing bottom wall, the housing bottom wall being all made of a plastic material; or, the housing bottom wall comprises an integrally molded metal sheet for increasing the space.

Although some specific embodiments of the invention have been demonstrated in detail by way of examples, it should be understood by a person skilled in the art that the above examples are only intended to be illustrative but not to limit the scope of the invention. It should be understood by a person skilled in the art that the above embodiments can be modified without departing from the scope and spirit of the present invention. The scope of the present invention is defined by the attached claims.

The invention claimed is:

1. A sound generator, comprising a housing, a vibration system and a magnetic circuit system; wherein, the vibration system and the magnetic circuit system are sequentially accommodated and fixed at a first end of the housing from top to bottom;

the magnetic circuit system is provided with a rear sound hole;

the housing comprises a first portion corresponding to the vibration system and the magnetic circuit system, and a second portion integrally extending downward from the first portion beyond a bottom surface of the magnetic circuit system;

a second end portion of the housing selected from the group consisting of a portion integrally provided with a housing bottom wall and a portion separately mounted with a lower cover plate;

wherein a rear cavity in communication with the rear sound hole is formed between the second portion of the housing, the bottom surface of the magnetic circuit system, and the housing bottom wall or the lower cover plate;

wherein the magnetic circuit system comprises a magnetic conductive yoke, and a central magnetic circuit portion mounted on an upper surface conductive magnetic conductive yoke and a side magnetic circuit portion, such that a magnetic gap accommodating a voice coil is positioned between the central magnetic circuit portion and the side magnetic circuit portion; and at least one of the central magnetic circuit portion and the side magnetic circuit portion are provided with a permanent magnet;

wherein the magnetic conductive yoke is rectangular, and a corner of the magnetic conductive yoke is provided with a first rear sound hole communicating with the magnetic gap and the rear cavity;

wherein the central magnetic circuit portion comprises a central magnet and a central magnetic conductive plate provided on a top surface of the central magnet; at the central magnetic circuit portion, the magnetic circuit system is provided with a through hole that sequentially penetrates the magnetic conductive yoke and the central magnet as a part of the rear cavity, and a second rear sound hole communicating with the through hole is provided on the central magnetic conductive plate; and wherein the four first rear sound holes and the second rear sound hole together constitute the rear sound hole provided on the magnetic circuit system.

2. The sound generator according to claim 1, wherein, the housing is a straight cylinder structure with openings at two ends;

the vibration system comprises a diaphragm and the voice coil fixed below the diaphragm, the diaphragm being fixed on an end surface of a first end opening of the housing; and the lower cover plate is mounted at a second end opening of the housing.

3. The sound generator according to claim 2, wherein, the first end of the housing is open, an inner side of an end surface of the first end opening of the housing has a recessed first step end surface, and the first step end surface has a bottom surface and a side surface for mounting the diaphragm.

4. The sound generator according to claim 3, wherein, an upper cover plate mounted on the housing is also provided above the diaphragm, and an edge of the upper cover plate is located inside the side surface of the first step end surface.

5. The sound generator according to claim 4, wherein, a first protrusion is provided outside the bottom surface of the edge of the upper cover plate, and an ultrasound line is provided on the first protrusion;

the bottom surface of the first step end surface is provided with a first groove at a position corresponding to the first protrusion, and the first protrusion of the upper cover plate is inserted into the first groove and is ultrasonically welded to a bottom surface of the first groove.

6. The sound generator according to claim 2, wherein, the first end of the housing is open, a second groove is provided outside an end surface of the first end opening of the housing, and the diaphragm is fixed inside the end surface of the first end opening;

an upper cover plate mounted on the housing is also provided above the diaphragm, and a second protrusion is provided outside a bottom surface of an edge of the upper cover plate, and the second protrusion extends into the second groove and is fixed by bonding.

7. The sound generator according to claim 1, wherein, an outer side of the side magnetic circuit portion is disposed in close contact with an inner wall of the housing.

8. The sound generator according to claim 1, wherein, a peripheral side of the magnetic conductive yoke is disposed in close contact with an inner wall of the housing.

9. The sound generator according to claim 1, wherein, a ratio of a volume of a through hole of the center magnet to an original volume of the center magnet prior to boring the through hole is 5% to 35%.

10. The sound generator according to claim 1, wherein, a second end of the housing is open, the lower cover plate is mounted at the second end opening of the housing, an inner wall of the first end of the housing is provided with a convex edge extending toward a center of the housing, and an upper edge of the magnetic circuit system abuts and is fixed on a lower surface of the convex edge.

11. The sound generator according to claim 1, wherein, the housing is of a rectangular structure.

12. The sound generator according to claim 1, wherein, the rear sound hole is provided with a breathable spacer, and the rear cavity is filled with a sound absorbing material.

13. The sound generator according to claim 12, wherein, the housing bottom wall or the lower cover plate is provided with a filling hole for filling the sound absorbing material, and a cover sheet is encapsulated on the filling hole.

14. The sound generator according to claim 13, wherein, the cover sheet is selected from the group consisting of a cover sheet provided with air-permeable micro-holes that allow air to pass and do not allow the sound absorbing material to pass and a cover sheet provided with a leak hole covered with a damping mesh that allows air to pass and does not allow the sound absorbing material to pass.

15. The sound generator according to claim 1, wherein, a second end of the housing is open, the lower cover plate is mounted at the second end opening of the housing, and the lower cover plate is made of metal.

16. The sound generator according to claim 15, wherein the lower cover plate is selected from the group consisting of a plate having a flat plate shape and a plate having a bowl-shaped structure provided with a bottom wall and a side wall.

17. The sound generator according to claim 1, wherein, a second end of the housing is open, the lower cover plate is mounted at the second end opening of the housing, and the lower cover plate is adhered to an end surface of the second end opening of the housing by a strand layer; or an inner side of the end surface of the second end opening of the housing is provide with a recessed second step end surface, the second step end surface is provided with a top surface and side surfaces for mounting the lower cover plate; the lower cover plate is of a flat plate shape, an edge of the lower cover plate is provided with a recessed portion recessed toward the rear cavity, the recessed portion abuts on the top surface of the second step end surface and forms a first holding strand groove between the side surfaces of the second step end surface, and the first holding strand groove is coated with strands to fix the lower cover plate on the housing; or, the lower cover plate is of a bowl-shaped structure provided with a bottom wall and a side wall, an end of the side wall of the lower cover plate is bent outward to provide a mounting edge, the mounting edge abuts on the top surface of the second step end surface and forms a second holding strand groove between the side surfaces of the second step end surface, and the second holding strand groove is coated with strands to fix the lower cover plate on the housing; or a plastic edge is injection-molded on a periphery of the lower cover plate, and the plastic edge is ultrasonically welded to the second end opening of the housing.

* * * * *